US007063675B2

(12) United States Patent
Hsu

(10) Patent No.: US 7,063,675 B2
(45) Date of Patent: Jun. 20, 2006

(54) ROTARY DEVICE OF CHAIR

(76) Inventor: Chang Chun Hsu, 235 Chung-Ho Box 8-24, Taipei (TW)

( * ) Notice: Subject to any disclaimer, the term of this patent is extended or adjusted under 35 U.S.C. 154(b) by 543 days.

(21) Appl. No.: 10/321,987

(22) Filed: Dec. 19, 2002

(65) Prior Publication Data

US 2004/0122342 A1 Jun. 24, 2004

(51) Int. Cl.
*A61H 1/00* (2006.01)

(52) U.S. Cl. ..... 601/5; 601/26; 601/91; 601/93

(58) Field of Classification Search ..... 601/49, 601/86, 87, 90, 91, 93, 98, 101, 26, 23, 24, 601/5, 143–146; 606/241, 32; 602/36
See application file for complete search history.

(56) References Cited

U.S. PATENT DOCUMENTS 1,753,518 A * 4/1930 Janette ..... 601/145
1,769,565 A * 7/1930 Goodrich ..... 601/144
2,068,992 A * 1/1937 Larsh ..... 601/145
3,667,453 A * 6/1972 Schenck et al. ..... 601/5
3,824,991 A * 7/1974 Whitaker ..... 601/5

* cited by examiner

*Primary Examiner*—Danton Demille
*Assistant Examiner*—Manuj Agarwal

(57) ABSTRACT

A rotary device of a chair comprises that has a chair body having a seat. A resisting body extends from a rear end of the seat. An annular handle is installed on the resisting body. The chair body has a driving means mechanism which is installed at the seat. The driving mechanism means has a deceleration motor, a worm rod, a worm gear and a chain. The deceleration motor has a deceleration gear. One end of the deceleration motor has a driving spindle. After the driving spindle is connected with the worm rod, the worm gear will be driven to rotate. The worm gear has a protruded driving shaft. One end of the chain is engaged to the driving shaft, while another end of the chain is engaged to the resisting body. The worm gear indirectly drives the resisting body and the handle.

8 Claims, 4 Drawing Sheets

ROTARY DEVICE OF CHAIR

FIELD OF THE INVENTION

The present invention relates to rotary structures, and particularly to a rotary device of a chair which can drive the upper half of the user to swing.

BACKGROUND OF THE INVENTION

In general, chairs serve to be seated by users. Massage chairs have a further function for massage. However, these kinds of chairs have only the function of stimulating the muscles at the backs of the users, but they can not be used to stimulate or massage the acupuncture points, veins and arteries. The reason is that the acupuncture points, veins and arteries are controlled at the backbone. Thereby, the massage chair can not massage these points.

Moreover, in the rehabilitation process, the nerves, muscles and acupuncture points are stimulated by extending the body, but this way can not effectively stimulate the nerves and acupuncture points on the backbone and lumbar vertebra. Thereby, the whole rehabilitation process, the rehabilitation operation of the rehabilitant must be assisted by rehabilitating member.

SUMMARY OF THE INVENTION

Accordingly, the primary object of the present invention is to provide a rotary device of a chair, wherein the backbone, nerves, muscles, acupuncture points, veins and arteries can be stimulated. Thereby, the waist of the user may swing as the user sits on the chair.

To achieve above objects, the present invention provides a rotary device of a chair comprising a chair body having a seat. A resisting body extends from a rear end of the seat; an annular handle being installed on the resisting body. The chair body has a driving means which is installed at the seat of the driving means. The driving means having a deceleration motor, a worm rod, a worm gear and a chain. The deceleration motor has a deceleration gear. One end of the deceleration motor has a driving spindle. After the driving spindle is connected with the worm rod, the worm gear will be driven to rotate. The worm gear has a protruded driving shaft. One end of the chain is engaged to the driving shaft, while another end of the chain is engaged to the resisting body. The worm gear indirectly drives the resisting body and the handle.

The various objects and advantages of the present invention will be more readily understood from the following detailed description when read in conjunction with the appended drawing.

DETAILED DESCRIPTION OF THE PREFERRED EMBODIMENTS

Figure 1:
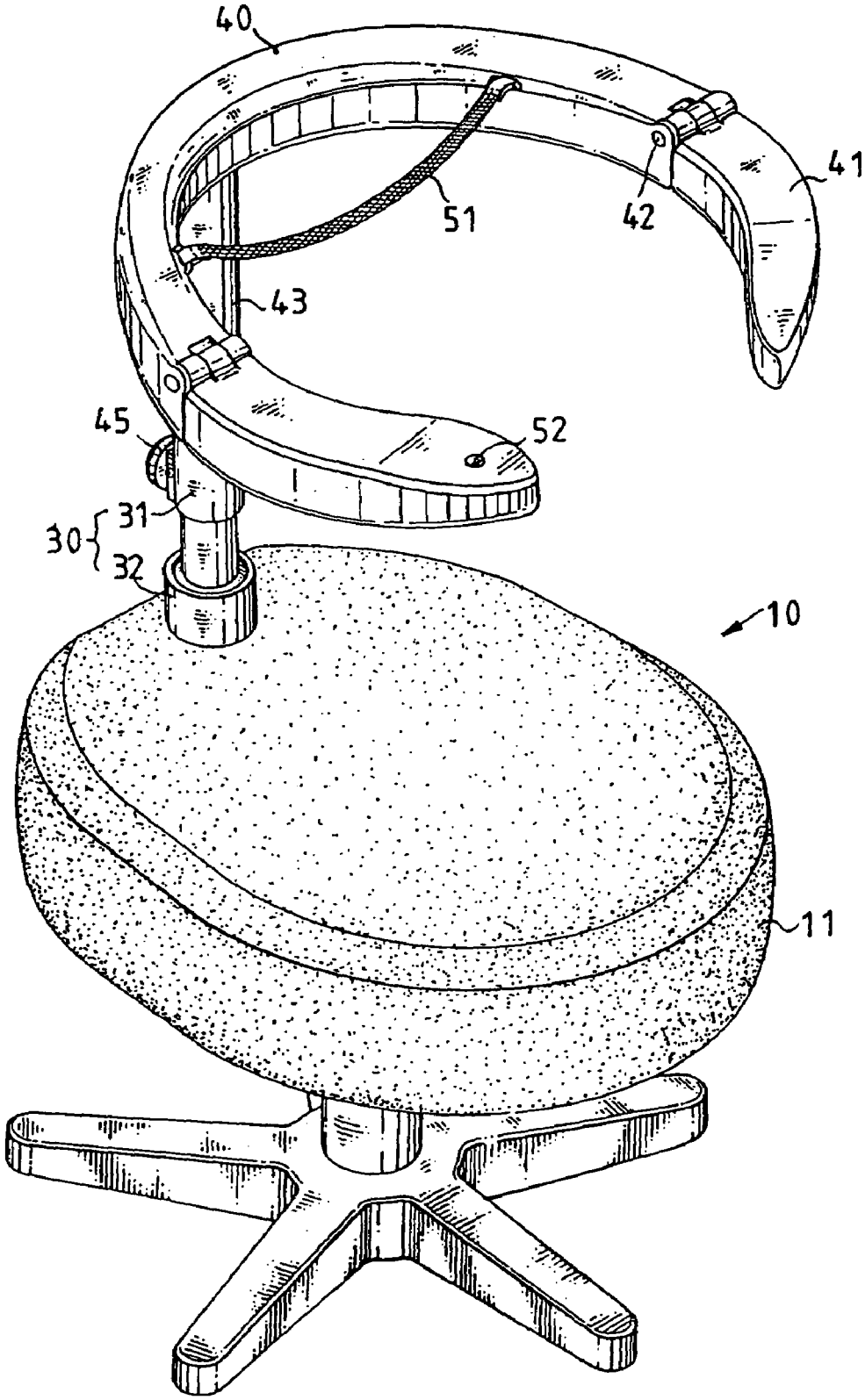
FIG. 1 is a perspective view of the present invention.
Figure 2:
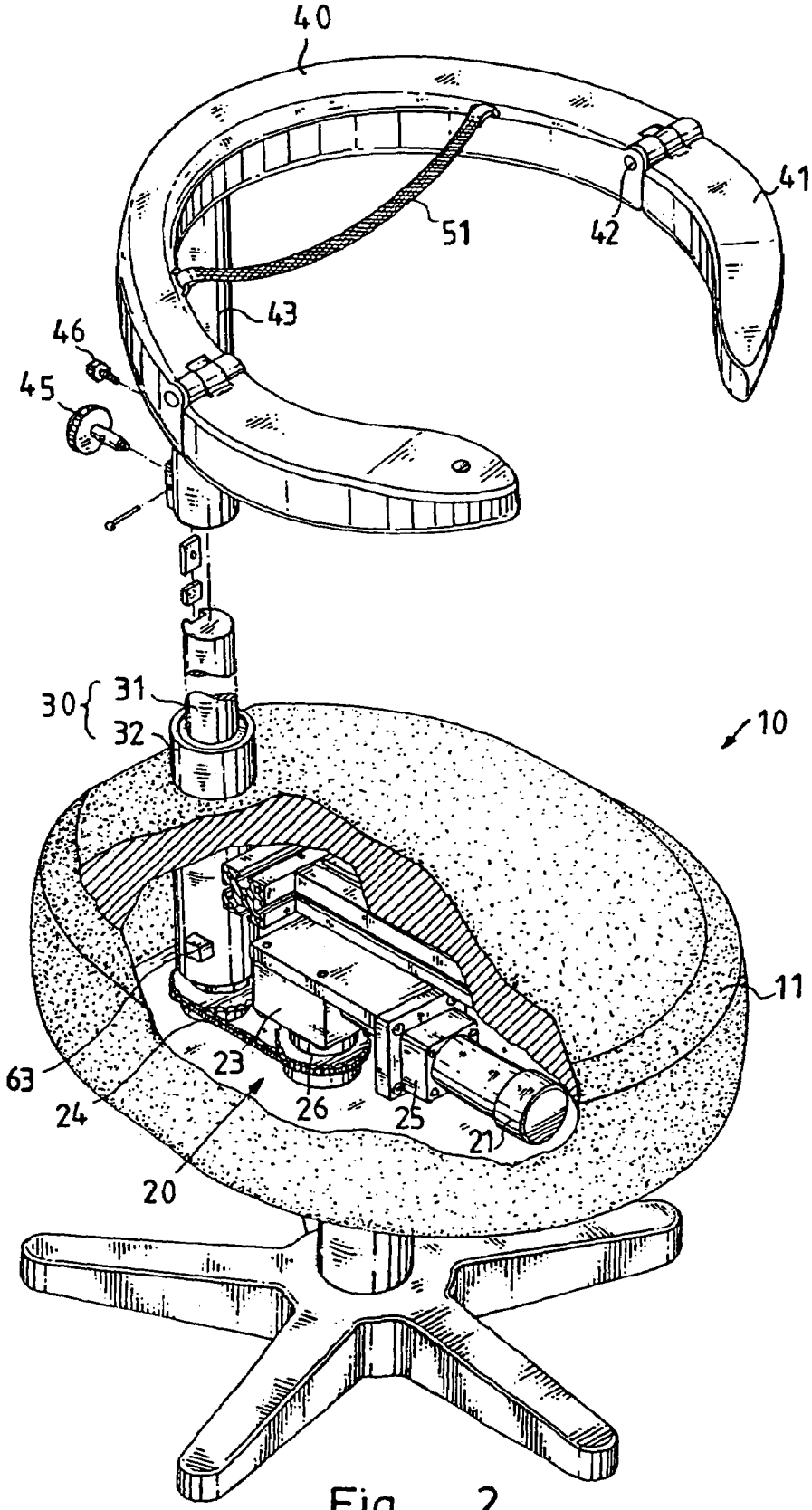
FIG. 2 is an exploded perspective view of the present invention.
Figure 3:
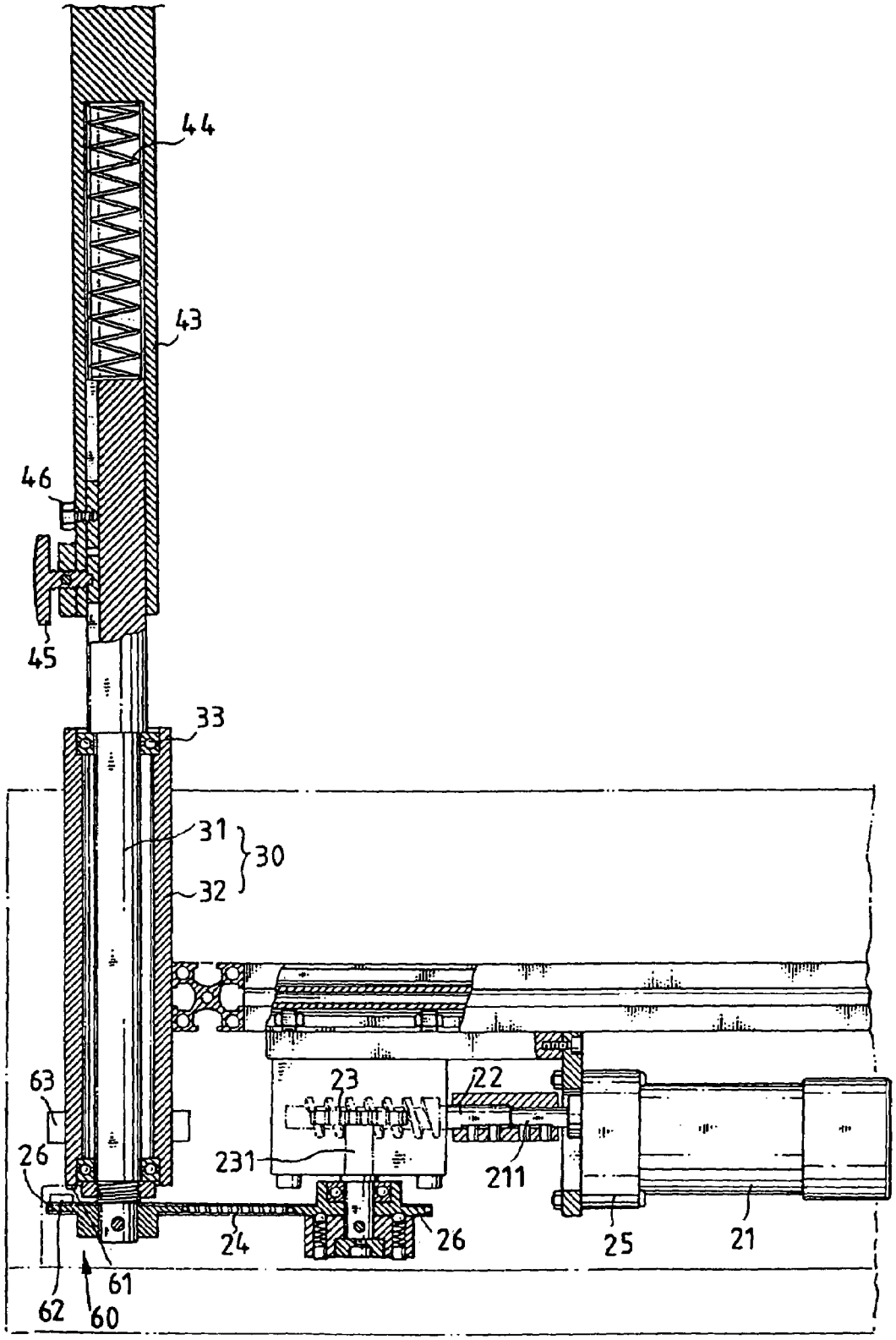
FIG. 3 is a cross sectional view of the present invention.
Figure 4:
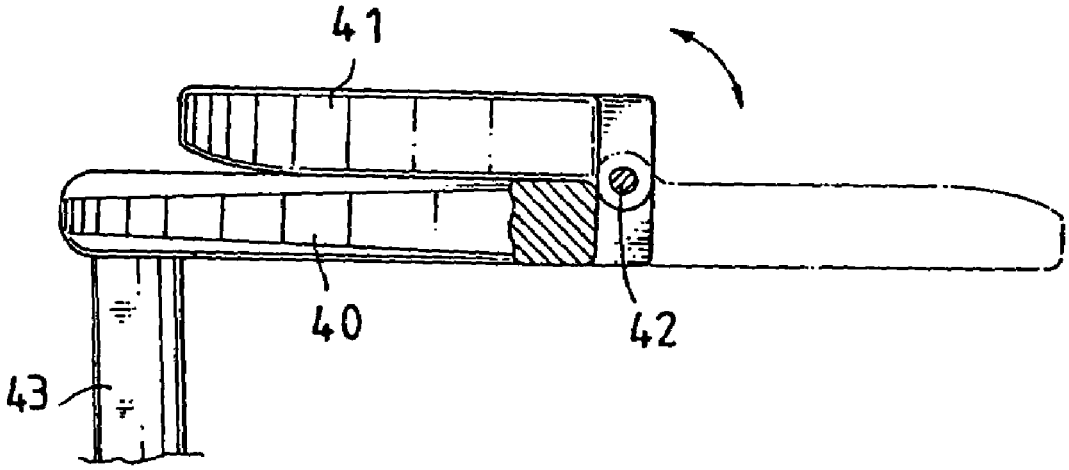
FIG. 4 is a schematic view showing the folding operation of the handle of the present invention.

Referring to FIGS. 1 to 3, the rotary device of a chair of the present invention is illustrated. The rotary device of a chair includes a chair body 10. The chair body 10 has a seat 11. A resisting body 30 extends from a rear end of the seat 11. A circular handle 40 is installed on the resisting body 30.

The chair body 10 has a driving means 20 which is installed in the seat 11. The driving means 20 has a deceleration motor 21, a worm rod 22, a worm gear 23 and a chain 24.

The deceleration motor 21 has a deceleration gear 25 at one end thereof. One end of the deceleration motor 21 has a driving spindle 211. After the driving spindle 211 is connected with the worm rod 22, the worm gear 23 will be driven to rotate. The worm gear 23 is a gear formed by a disk with a protruded driving shaft 231. The driving shaft 231 protrudes outwards and has a teeth disk 26. One end of the chain 24 may be engaged to the teeth disk 26, while another end of the chain 24 is engaged to a lower end of the resisting body 30 by another teeth disk 26. The worm gear 23 can indirectly drive the resisting body 30 and the handle 40 on the resisting body 30. Moreover, the deceleration motor 21 can be installed with a rectifier, a transformer and a speed controller (not shown) so that the operation of the deceleration motor 21 may be more steady and smooth.

Referring to FIG. 3, the amplitude of the resisting body 30 and the handle 40 are controlled by a sensor set 60. The sensing piece 62 is installed at an upper surface of the teeth disk 26 with respect to the sensors 61. When the deceleration motor 21 receives a signal, the deceleration motor 21 will change direction so as to achieve the object of control the swing angle of the handle 40. When a user presses a stop switch, the sensor 61 will cause the handle 40 to return to the middle position.

As described above, in the resisting body 30, a long straight driving rod 31 passes through an outer sleeve 32. The upper and lower ends of the driving rod 31 have a thrust bearing 33 at the inner edge of the outer sleeve 32.

A cambered means 41 is at a front end of the handle 40. The cambered means 41 may be folded. A pivotal rod 42 serves to connect the cambered means 41 with the body of the handle 40. The handle 40 is engaged to the driving rod 31 through an engaging portion 43 so that the handle 40 is positioned to the resisting body 30. The position of the handle 40 can be adjusted longitudinally. An interior of the engaging portion 43 is mounted with an elastomer 44 and an exterior of the engaging portion 43 is mounted with an adjusting stud 34 and a locking threaded rod 46. One end of the elastomer 44 resists against the end surface of the driving rod 31. One end of the adjusting stud 34 can be screwed into the interior of the engaging portion 43 so that the end portion thereof resists against the driving rod 31 to fix the handle 40. Since the elastomer 45 is a compressible spring, the position adjustment of the handle can be performed steadily and smoothly.

Moreover, the handle is further installed with a control switch 52 and a safety waist belt 51. The control switch 52 serves for switching the deceleration motor 21. The safety waist belt 51 serves to avoid the waist of the user tightly resisting against the handle 40.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A rotary device of a chair comprising a chair body; the chair body having a seat; a resisting body extending from a rear end of the seat; an annular handle being installed on the resisting body; characterized in that:

the chair body has a driving means which is installed in the seat;

the driving means having a deceleration motor, a worm rod, a worm gear connected to the worm rod and a chain;

the deceleration motor has a deceleration gear at one end thereof; one end of the deceleration motor has a driving spindle; after the driving spindle is connected with the worm rod, the worm gear will be driven to rotate as the deceleration motor rotates; the worm gear has a protruded driving shaft; one end of the chain is engaged to a teeth disk of the driving shaft, while another end of the chain is engaged to a lower end of the resisting body; the worm gear indirectly drives the resisting body and the handle on the resisting body.

2. The rotary device of a chair as claimed in claim 1, wherein the resisting body has a long straight driving rod passing through an outer sleeve; upper and lower ends of the driving rod have thrust bearings at inner side of the outer sleeve; an outer side of the handle has an adjusting stud and a threaded rod, and an inner side of the handle has an elastomer; thereby, the position of the handle is adjustable.

3. The rotary device of a chair as claimed in claim 1, wherein a cambered portion is formed at a front end of the handle; a pivotal rod is used to pivot the cambered portion with other part of the handle.

4. The rotary device of a chair as claimed in claim 2, wherein a cambered portion is formed at a front end of the handle; a pivotal rod is used to pivot the cambered portion with other part of the handle.

5. The rotary device of a chair as claimed in claim 1, wherein the handle is installed with a safety waist belt.

6. The rotary device of a chair as claimed in claim 2, wherein the handle is installed with a safety waist belt.

7. The rotary device of a chair as claimed in claim 1, wherein a handle is installed with a control switch.

8. The rotary device of a chair as claimed in claim 2, wherein a handle is installed with a control switch.

* * * * *